US006346783B1

(12) United States Patent
Belliveau

(10) Patent No.: US 6,346,783 B1
(45) Date of Patent: Feb. 12, 2002

(54) METHOD AND APPARATUS FOR AUTOMATICALLY POSITION SEQUENCING A MULTIPARAMETER LIGHT

(76) Inventor: Richard S. Belliveau, 10643 Floral Park, Austin, TX (US) 78759

( * ) Notice: Subject to any disclaimer, the term of this patent is extended or adjusted under 35 U.S.C. 154(b) by 0 days.

(21) Appl. No.: 09/650,305

(22) Filed: Aug. 29, 2000

(51) Int. Cl.[7] ..... H05B 37/00

(52) U.S. Cl. ..... 315/317; 315/312; 315/316; 315/149; 362/85; 340/825.24; 340/825.25

(58) Field of Search ..... 315/5, 312, 316, 315/317, 149; 362/85; 340/825.24, 825.25

(56) References Cited

U.S. PATENT DOCUMENTS

| | | | | | |
|---|---|---|---|---|---|
| 3,706,914 | A | | 12/1972 | Van Buren | 315/316 |
| 3,898,643 | A | | 8/1975 | Ettlinger | 700/84 |
| 4,095,139 | A | | 6/1978 | Symonds et al. | 315/153 |
| 4,392,187 | A | | 7/1983 | Bohnhorst | 362/223 |
| 4,697,227 | A | | 9/1987 | Callahan | 362/223 |
| 4,947,302 | A | * | 8/1990 | Callahan | 315/312 |
| 5,402,326 | A | | 3/1995 | Belliveau | 362/284 |
| 5,414,328 | A | * | 5/1995 | Hunt et al. | 315/316 |
| 6,048,080 | A | | 4/2000 | Belliveau | 362/282 |

OTHER PUBLICATIONS

Carlson, Steven B., A Guided Tour of DMX512, ROSCO/Entertainment Technology, Mar. 25, 1996 (printed Jul. 20, 1999).

High End Systems, Inc., Product Catalog 2000.

United States Institute for Theatre Technology, Inc., DMX512/1990 Digital Data Transmission Standard for Dimmers and Controllers.

Apr. 1990, Reprinted Jun. 14, 1994, Duplication Date Aug. 2000, and AMX192 Analog Multiplex Data Transmission Standard for Dimmers and Controllers, Aug. 1986, Revised Feb. 1987, Reprinted Jul. 1990, Duplication Date Aug. 2000.

* cited by examiner

*Primary Examiner*—Don Wong
*Assistant Examiner*—Jimmy T. Vu
(74) *Attorney, Agent, or Firm*—Dorsey & Whitney LLP

(57) ABSTRACT

The patterned light beam from a multiparameter light is moved by a position sequence macro that automatically references the present position of projection of light from the multiparameter light. The present position of projection may be, for instance, the last position of the multiparameter light prior to the position sequence macro as indicated by a position parameter for the multiparameter light, and the position sequence macro controls movement of the patterned light beam through several different positions of pan and/or tilt that are, for example, centered on a position specified in the position parameter. The position parameter may be specified remotely by a lighting control system or at the multiparameter light itself. Other parameters such as, for example, color, iris and shutter may be varied as well.

54 Claims, 6 Drawing Sheets

METHOD AND APPARATUS FOR AUTOMATICALLY POSITION SEQUENCING A MULTIPARAMETER LIGHT

BACKGROUND OF THE INVENTION

1. Field of the Invention

The present invention relates to theatre lighting, and more particularly the automated positioning of a patterned beam from a multiparameter light.

2. Description of Related Art

Multiparameter lights are useful for many dramatic and entertainment purposes such as, for example, Broadway shows, television programs, rock concerts, restaurants, nightclubs, theme parks, the architectural lighting of restaurants and buildings, and other events. A multiparameter light typically includes a light source and one or more effects known as "parameters" that are controllable by an operator from an external lighting control system. For example, U.S. Pat. No. 4,392,187 issued Jul. 5, 1983 to Bohnhorst and entitled "Computer controlled lighting system having automatically variable position, color, intensity and beam divergence" describes multiparameter lights and a lighting control system. Multiparameter lights typically offer several variable parameters such as strobe, pan, tilt, color, pattern, iris and focus.

Multiparameter lights are able to project color or patterns of light on, for example, a stage, a room, an arena, or the external features of a building, to achieve a desired lighting effect. In some types of multiparameter lights, patterns of light are created within the beam typically by the use of such components as stencils and lithos. Patterns of light may be caused to rotate by rotating the stencils and lithos in the beam. In other types of multiparameter lights, patterns of light are created within the beam by the use of special lenses such as lenticular lenses. The location of patterns of light projected by the multiparameter light from scene to scene is controlled by a position parameter, which may be varied by the operator of the lighting control system. Typically, a multiparameter light receives commands such as the position parameter from the lighting control system, and includes some form of internal control system to handle communications and control operation of the various components of the multiparameter light. Typically, the internal control system includes a controller integrated circuit or microprocessor and associated memory for storing operational code and data. The operator of the lighting control system uses a joystick or other input device to move the patterned beam from the multiparameter light to the desired location. Each multiparameter light has a separate communications address so that the respective locations for the patterns projected by the multiparameter light may be individually set. Typically thirty or more multiparameter lights may have their projections positioned to provide the desired lighting effect.

A particular type of multiparameter light known as the Emulator laser simulator, previously available from High End Systems of Austin, Texas, created patterns of light with beam movement rather than with stencils. The Emulator laser simulator produced a narrow beam of light by using a Xenon lamp and an optical system to collimate the light from the Xenon lamp. The collimated beam of light was passed within the housing through a color wheel to a shutter, an X scanning mirror, a Y scanning mirror, and an exiting aperture. Unlike conventional multiparameter lights which use stencils to create patterns of light, the Emulator laser simulator created specific patterns of light by directing the collimated beam with the X and Y scanning mirrors as specified by a "program" parameter. Instructions for creating the patters of light were stored in the Emulator light itself as non-changeable factory code. The patterns were selected by the lighting control system for the Emulator laser simulator, which used a dedicated protocol. The lighting control system for the Emulator laser simulator could control multiple Emulator laser simulators by addressing them separately and then selecting the parameters to be adjusted. For example, the operator of the lighting control system for the Emulator laser simulator might first have selected one of the Emulator laser simulators to be addressed in a particular scene. Next the operator might have set the program parameter to select a pattern to be created by movement of the straight beam of collimated light. The pattern might have had several other operator-selected variables such as scanning rate and pattern size. Next the operator might have selected a color and/or strobe. The operator might have move the pattern to a particular position by changing the position parameter, the pattern being reference to the position parameter. The operator might have moved the pattern to different positions during a show by changing the position parameter from scene to scene.

Prior to the advent of relatively small commercial digital controllers, remote control of light fixtures was done with either a high voltage or low voltage current; see, e.g., U.S. Pat. No. 3,706,914, issued Dec. 19, 1972 to Van Buren, and U.S. Pat. No. 3,898,643, issued Aug. 5, 1975 to Ettlinger. With the widespread use of digital computers, digital serial communications has been adopted as a way to achieve remote control; see, e.g., U.S. Pat. No. 4,095,139, issued Jun. 13, 1978 to Symonds et al., and U.S. Pat. No. 4,697,227, issued Sep. 29, 1987 to Callahan.

Some time ago, a number of proprietary protocol schemes for serial communications with theatre devices were developed, which left the user desiring to control theatre devices from different manufacturers with the necessity of having to use an array of different equipment using different protocols designed by the respective manufacturers. In response to this situation, the United States Institute of Theatre Technology ("USITT") in 1986 adopted a standard digital communications system protocol for theatre devices known as DMX512. While the DMX512 protocol has been updated several times since its adoption, the basic communications protocol remains the same. Basically, the DMX512 protocol requires a continuous stream of data at 250 Kbaud which is communicated one-way from the lighting control system to the theatre devices. Typically, the theater devices use an Electronics Industry Association ("EIA") standard for multi-point communications know as RS-485. Information on DMX512 can be found in the publication "Digital Data Transmission Standard for Dimmers and Controllers" by the United States Institute for Theatre Technology Inc, 6443 Ridings Road Syracuse, N.Y. 13206-1111 USA. he DMX 512 protocol allows for up to 512 separate control channels.

FIG. 1 shows an illustrative multiparameter lighting system based on the USITT DMX512 protocol. Power mains 12 provide AC power to a controller 10 and multiparameter lights 20, 22, 24, 26, 32, 34 and 36 over standard building electrical wiring 14. A communications cable 16 is run from the controller 10 to the first multi-parameter light fixture 20, and additional communication cable segments 21, 23, 25, 31, 33 and 35 sequentially connect the light fixtures 22, 24, 26, 32, 34 and 36. While only seven multiparameter lights are shown in FIG. 1 for clarity, typically multiparameter lighting systems may have thirty or more such lights. Lighting control systems are available from several manufacturers, including High End Systems, Inc. of Austin, Tex.

An illustrative light fixture 100 suitable for use in the multi-parameter lighting system of FIG. 1 is shown in greater detail in FIGS. 2 and 3. The front view of FIG. 2 shows a lamp housing 110 which has a light exit aperture 111. The lamp housing 110 is rotatably attached to a yoke 108 by two bearing assemblies 107 and 109. The yoke 108 is in turn rotatably attached by a bearing assembly 105 to an electronics housing 104, which contains a power supply, a communications receiver, and the internal control system. While multiple bearing assemblies typically are used, simplified bearing assemblies—bearing 105 for pan, bearings 107 and 109 for tilt—are shown in the figure for clarity. A line power cord 102 for connecting the multiparameter light fixture 100 to the power mains 12 (FIG. 1) extends from the electronics housing 104. A panel area on the electronics housing 104 contains a display and a keypad 106 for viewing and entering data. The side view of FIG. 3 shows that the electronics housing 104 also includes a pair of digital communications terminals, one of which is a digital input terminal 112 designated DIGITAL LINE IN and the other of which is a digital output terminal 114 designated DIGITAL LINE OUT. Respective communications cables plug into the terminals 112 and 114, and multiparameter lights may receive signals, pass signals, or originate signals through these terminals. Multiparameter lights are available from several manufacturers, including High End Systems, Inc. of Austin, Tex.

Different types of multiparameter lights have different types of light positioning apparatus. FIGS. 2 and 3 show one illustrative type of multiparameter light in which the base and lamp sections are separate and the lamp section is movable relative to the base so that it may be variably positioned under operator control, thereby enabling the projection of a light beam over a range of directions. Another illustrative type of multiparameter light (not shown) is contained in a single housing and uses a reflector (one or more) that is movable relative to the housing so that it may be variously positioned under operator control, thereby enabling the projection of a light beam over a range of directions.

Under the DMX512 protocol, each control channel may provide up to 256 separate values. A multiparameter light operating with the DMX512 protocol may require the use of several control channels to operate the parameters. If a multiparameter light has 12 parameters to be varied, it is quite likely that a minimum of 12 separate control channel addresses may be used by the light. Often additional channels are used to increase the resolution of parameter control. For example, 256 channel values may not provide the desired resolution of control for the pan positioning of a typical multiparameter light, which is capable of panning 360 degrees. FIG. 4 shows a typical multiparameter light in which the lamp housing 110 is at 90 degrees relative to the electronics housing or base 104. The arc 130 indicates a portion of the 360 degree panning range of the lamp housing 110 relative to the base 104. A light beam 120 is projected from the lamp housing 110. FIG. 5 shows the lamp housing 110 panned with a pan parameter of 135 degrees relative to the base 104. FIG. 6 shows the lamp housing 110 panned with a pan parameter of 45 degrees relative to the base 104. The 256 values available on a single channel enables a resolution of pan movement of only 256 positions, less than the 360 degrees of pan desired. When one channel cannot provide the desired resolution, two control channels are used to provide 256 by 256 different positions. Also additional control channels may be used to control various other conditions of the multiparameter light such as enabling the lamp or entering into special modes of operation.

When controlling multiparameter lights, the operator inputs to a keyboard of the lighting control system to send commands over the communications system to vary the parameters of the lights. When the operator of the lighting control system has set the parameters of the multiparameter lights to produce the desired effect, the operator has produced a "scene." Each scene with its corresponding parameter values is then stored in the memory of the lighting control system for later recall by the operator or as an automated recall. As many as 100 or more scenes may be put together to make a "show". The respective positions of the multiparameter lights may be different within each scene. As the lighting control system recalls each scene that has been programmed by the operator, the multiparameter lights move the projected light, which typically includes many different patterns, from one location to another in accordance with the operator's program by varying the pan and tilt parameters (also generally referred to as the position parameter). As the projected light is repositioned from scene to scene, a pleasing visual movement is created. The movement may be fast or slow and is at the discretion of the programmer when the programmer programs the scenes.

Programming the many scenes for the show can be tedious. The operator of the lighting control system may work for several days to vary the hundreds of parameters available when utilizing thirty or more multiparameter lights. Unfortunately, the operator may not always have sufficient time available to create the desired effect because of the limited time that may be available to him. Many shows have limited rehearsal time which restricts the amount of programming time available to the operator.

To facilitate programming a show, manufacturers have added macros to multiparameter lights of the types that use such components as stencils, lithos, and lenticular lenses to pattern their beams. These macros function in the operational code and are selectable with the control protocol of the multiparameter light to provide some automation of a parameter with the corresponding command. The macros that are selectable by the control protocol may be located in addition to the normal operation of the parameter. For instance, when using the DMX protocol and controlling the shutter of a multiparameter light, a single DMX control channel may be utilized to allow the operator to open the shutter and let light be projected or close the shutter and stop the light from being projected. The single DMX control channel incorporates not only the specific open and close commands for the shutter but also might include additional commands or macros. With a macro, the shutter may be opened and closed many times a second by only using one command. This macro command creates a stroboscope. Without the stroboscope macro, the operator would have to create many scenes that would include a general open and close command. It is easy to see that with the macro command only a single command is used within a scene by an operator to cause a stroboscope. This saves the operator a great amount of programming time.

In known systems using DMX, macros may be located on the same channel of the parameter they affect or they may be located on a separate channel that is devoted to only macros.

High End Systems of Austin, Tex. provides macros for several different parameters to save operators time when they program shows. One of the macros available un the multiparameter lights of High End Systems is a macro control channel of a general nature known as the macro channel. The macro control channel can be found, for example, in the Studio Spot™ Automated Luminaire. The macros available for the Studio Spot multiparameter light allow the operator to use the macro control channel to call up the macros when addressing the light. When a macro command is given, the light is automatically moved through several different positions while simultaneously changing several other parameters such as, for example, color, pattern and shutter.

The macros that include multiple position changes of the prior art have a notable disadvantage. The macros that provide the multiple position changes are preprogrammed by the manufacturer in the multiparameter light operating code, and these multiple positions commonly reference a predetermined and preprogrammed initial position of the light. The initial position typically is the first position that the light arrives at after initializing upon turn-on, and typically is programmed into the operating code of the multiparameter light by a software programmer in a development laboratory. If an operator chooses to call up a macro that includes multiple position changes for the light positioning apparatus of the multiparameter light, the projected light will move only to the positions programmed by the factory. Even though the multiparameter light may already have some value of position that has been given by the lighting control system when the macro is called up, the macro references only the starting position as originally specified in the operational code and ignores any position that the lighting control system has established.

This disadvantage is illustrated in FIGS. 7 and 8. FIG. 7 shows a pan position of 225 degrees relative to a base position of zero degrees, as indicated by the arrow projecting from the center of the 360 degree circle at the 225 degree position. The operator may set this pan position on a particular multiparameter light and the lamp housing responds by moving into that position. Now, when the operator commands a position sequence macro for a 40 degree panning range, the multiparameter light references a factory preprogrammed position of, say, 180 degrees and pans 20 degrees on each side thereof, as shown in FIG. 8 by the arrows projecting from the center of the 360 degree circle at the 160 degree and 200 degree positions. The dotted arrow projecting from the center of the 360 degree circle at the 225 degree position represents the previous position of the lamp housing as set by the operator, which was ignored.

Unfortunately, these factory originally specified starting positions may not be useful to the operator in providing the desired effect. For example, if an operator has programmed or positioned a multiparameter light to project a patterned beam on the center of a stage and a macro that involves position changes is called up by the operator, the pattern will start to automate its positions as provided by the macro using a starting position that was put into the operational code by the manufacturer. The macro likely will automate the position changes of the multiparameter lights in directions that is away from the center of the stage, often considerably so. As a specific example, consider an installation in which the multiparameter lights are mounted around the stage in a circular fashion—not all mounted facing the same direction when referencing the stage. If the operator selects the desired pattern or patterns and calls up a known position sequence macro for the multiparameter lights, all of the multiparameter lights will automate in reference to the original factory programmed positions regardless of any position originally set by the operator. This means that the multiparameter lights mounted around the stage in a circular fashion will move through their automated positions without achieving the lighting effect desired by the operator.

SUMMARY OF THE INVENTION

It is the object of the invention to reference position sequence macros of a multiparameter light to a position having a relationship to the show rather than solely to a manufacturer designated position.

This and other objects are achieved in various ways by the various embodiments of the present invention. For example, one embodiment of the present invention is a method of programming a lighting system comprising at least one multiparameter light, the multiparameter light comprising a light positioning apparatus controlled by a position parameter and a beam pattern selected by a pattern parameter. The method comprises providing a plurality of macros for the multiparameter light, each of the macros comprising position sequences for the light positioning apparatus referenced to the position parameter; projecting a light beam from the light positioning apparatus; setting the pattern parameter to impose the beam pattern on the light beam; setting the position parameter to move the light beam to a selected location; setting a macro parameter to activate at least one of the macros, wherein the light beam from the pattern parameter setting step is moved sequentially to a plurality of locations as determined by the position sequences of the activated macro with reference to the position parameter from the position parameter setting step; recording the setting of the position parameter from the position parameter setting step; recording the setting of the pattern parameter from the pattern parameter setting step; and recording the setting of the macro parameter from the macro parameter setting step.

Another embodiment of the invention is a method of operating a lighting system comprising at least one multiparameter light the multiparameter light comprising a light positioning apparatus controlled by a position parameter and a beam pattern selected by a pattern parameter. The method comprises projecting a light beam from the light positioning apparatus; providing a pattern parameter for the multiparameter light; providing a position parameter for the multiparameter light; providing a plurality of macros having position sequences for the light positioning apparatus of the multiparameter light, the position sequences being referenced to the position parameter; setting the position parameter to selectively position the light positioning apparatus; and setting a macro parameter to activate at least one of the macros; wherein the light beam is patterned as determined by the pattern parameter and moves sequentially to a plurality of locations as determined by the position sequences of the activated macro with reference to the position parameter.

Yet another embodiment of the invention is a multiparameter light comprising a beam patterning apparatus; a light positioning apparatus capable of being variably positioned; a communications receiver; and a internal control system coupled to the communications receiver, the beam patterning apparatus, and the light positioning apparatus. The internal control system comprises a plurality of macros having position sequences for the light positioning apparatus; programmed logic responsive to a first value received by the communications receiver for activating the beam patterning apparatus; programmed logic responsive to a second value received by the communications receiver for positioning the light positioning apparatus; and programmed logic responsive to a third value received by the communications receiver for selecting at least one of the macros, the position sequences of the selected macro being referenced to the second value.

A further embodiment of the invention is a multiparameter light comprising a beam .patterning apparatus; a light positioning apparatus capable of being variably positioned; a keypad; and a internal control system coupled to the keypad and to the light positioning apparatus. The internal control system comprises a plurality of macros having position sequences for the light positioning apparatus; programmed logic responsive to a first value originating from the keypad for activating the beam patterning apparatus; programmed logic responsive to a second value originating from the keypad for positioning the light positioning apparatus; and programmed logic responsive to a third value originating from the keypad for selecting at least one of the macros, the position sequences of the selected macro being referenced to the second value.

Yet a further embodiment of the invention is a lighting system for producing a show, the lighting system comprising a lighting control system and at least one multiparameter light. The multiparameter light comprises a beam patterning apparatus; a light positioning apparatus capable of being variably positioned; a communications receiver coupled to the lighting control system; and a internal control system coupled to the communications receiver and to the light positioning apparatus. The internal control system comprises a plurality of macros having position sequences for the light positioning apparatus; programmed logic responsive to a first value received by the communications receiver from the lighting control system for activating the beam patterning apparatus; programmed logic responsive to a second value received by the communications receiver from the lighting control system for positioning the light positioning apparatus; and programmed logic responsive to a third value received by the communications receiver from the lighting control system for selecting at least one of the macros, the position sequences of the selected macro being referenced to the second value.

DETAILED DESCRIPTION OF THE PREFERRED EMBODIMENT

Figure 1:
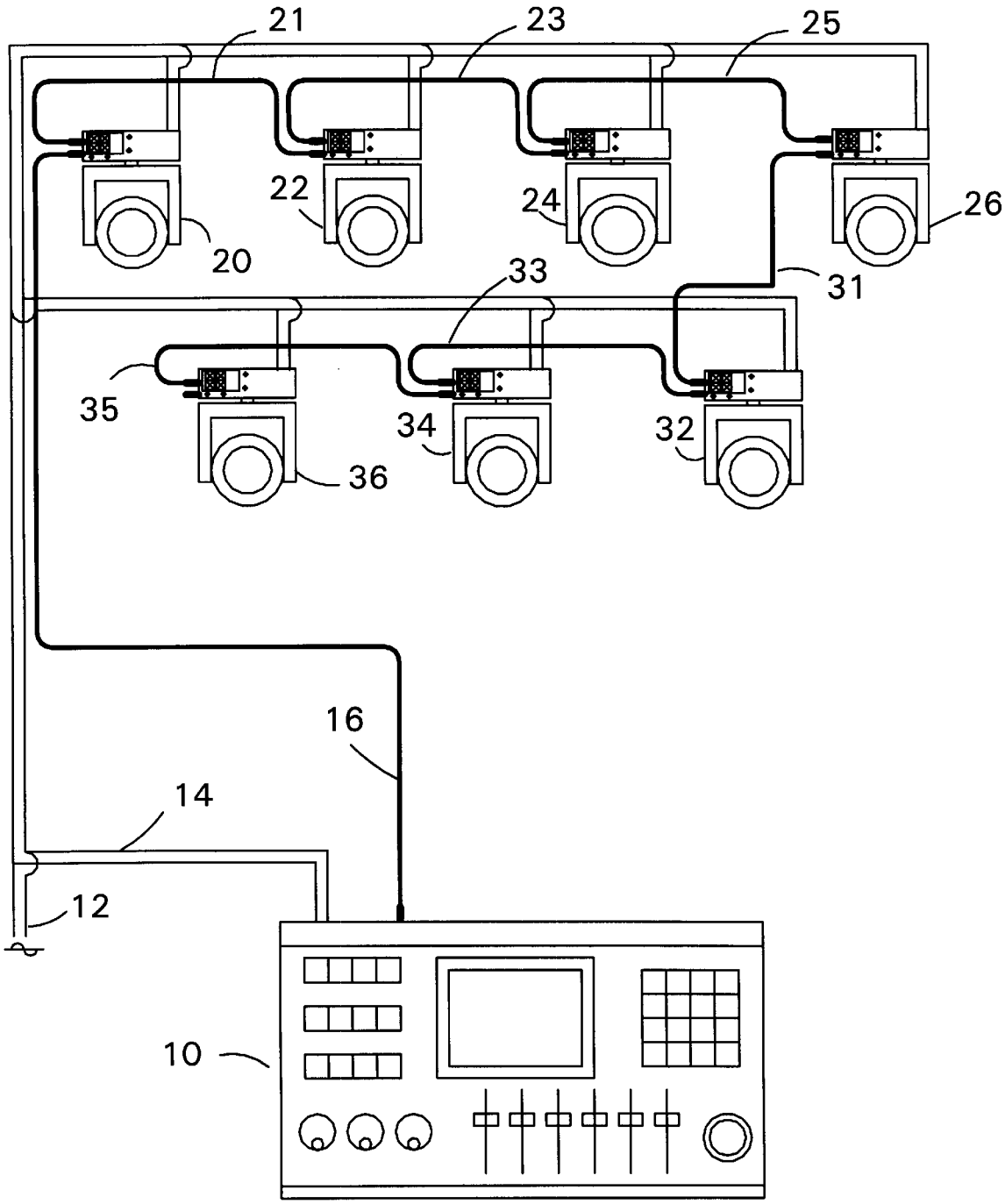
FIG 1 (PRIOR ART)
FIG. 1 is a schematic diagram of a prior art multiparameter lighting system using the USITT DMX512 protocol.
Figure 2:
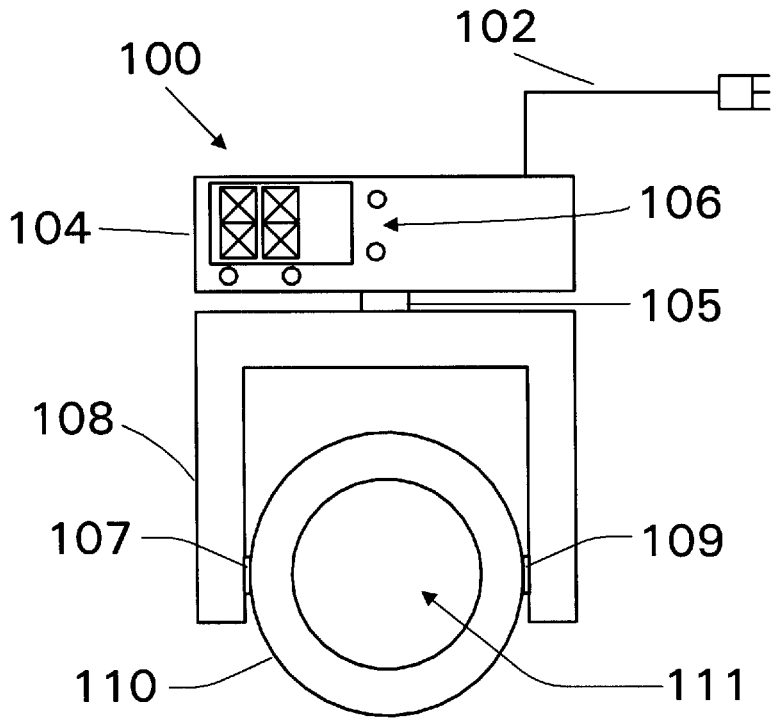
FIG 2 (PRIOR ART)
FIG. 2 is a front plan view of a prior art multiparameter light suitable for use in the multiparameter lighting system of FIG. 1.
Figure 3:
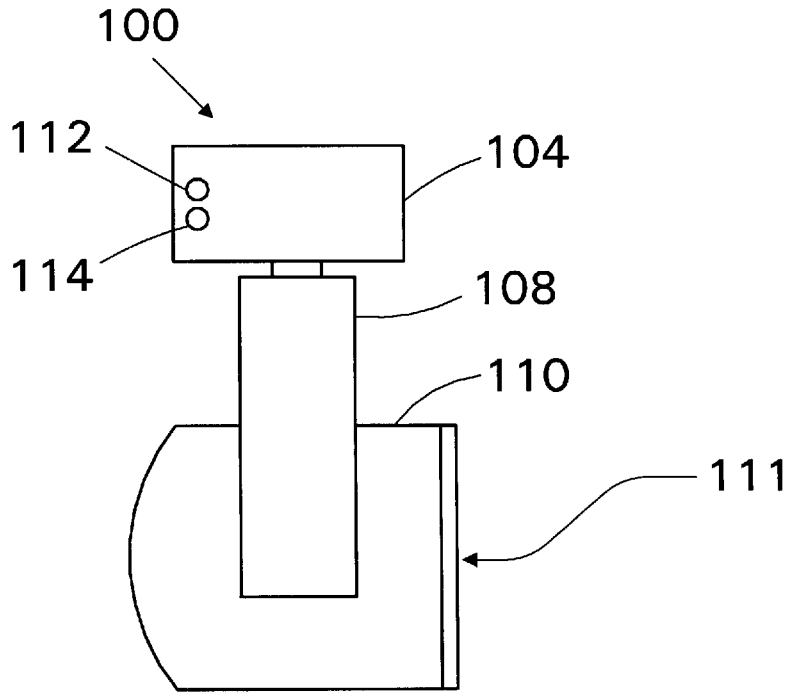
FIG 3 (PRIOR ART)
FIG. 3 is a side plan view of a prior art multiparameter light suitable for use in the multiparameter lighting system of FIG. 1.
Figure 4:
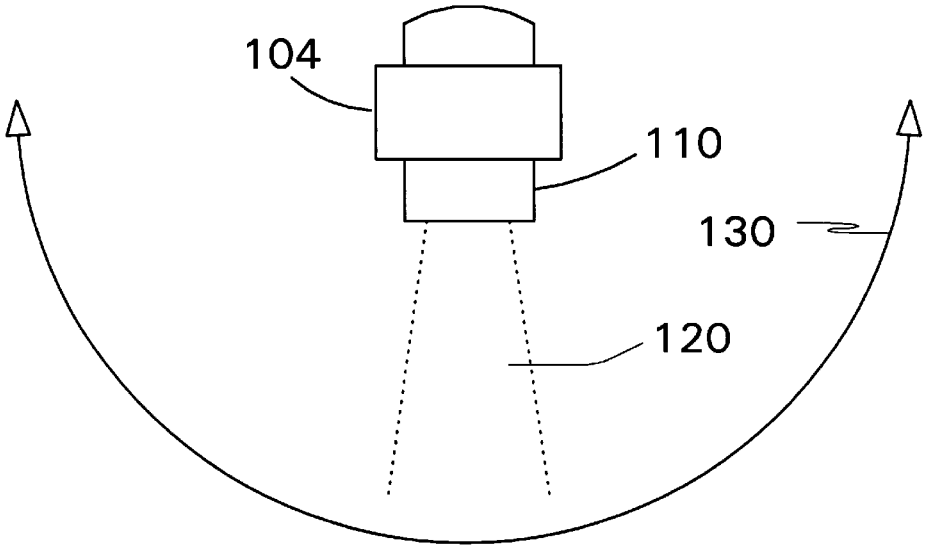
FIG 4 (PRIOR ART)
FIGS. 4, 5 and 6 are schematic views showing various pan positions of a lamp housing of a multiparameter light in the prior art.
Figure 5:
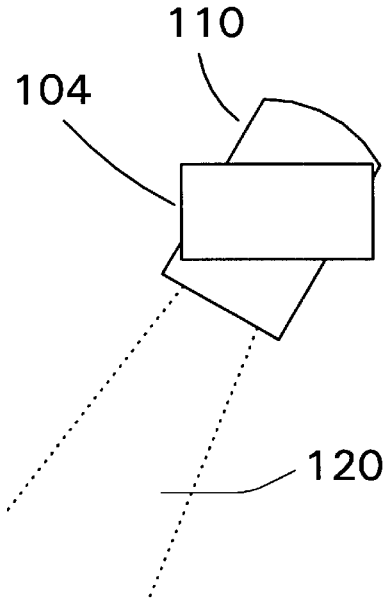
FIG 5 (PRIOR ART)
Figure 6:
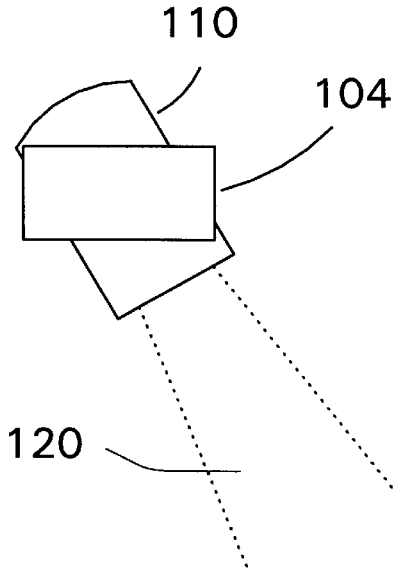
FIG 6 (PRIOR ART)
Figure 7:
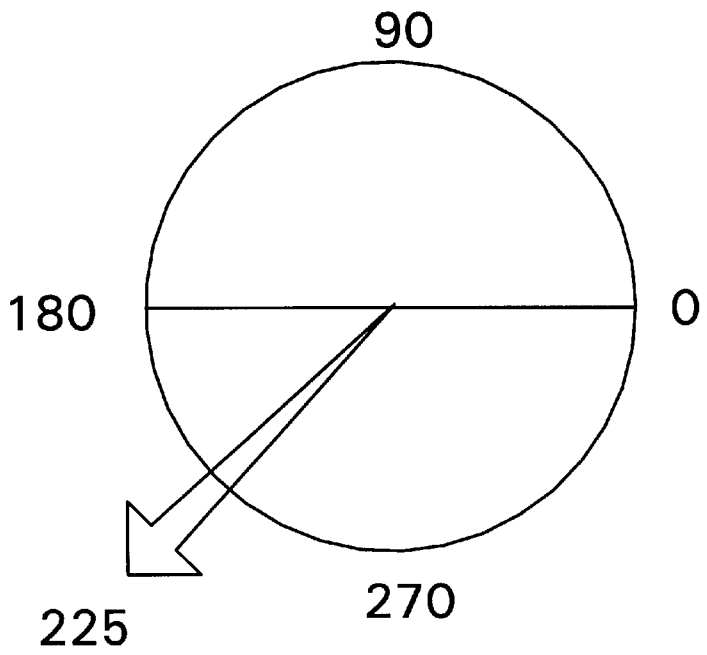
FIG 7 (PRIOR ART)
FIG. 7 is a schematic representation of a pan position as set by an operator in the prior art.

A multiparameter light is a type of theater light that includes a light source such as a lamp in combination with one or more optical components such as reflectors (the lamp and reflector may be integrated if desired), lenses, filters, iris diaphragms, shutters, and so forth for creating special lighting effects, various electrical and mechanical components such as motors and other types of actuators, wheels, gears, belts, lever arms, and so forth for operating some of the optical components, a suitable internal control system for controlling the parameters of the multiparameter light, and suitable power supplies for the lamp, motors, and electronics. The internal control system preferably is implemented as software programmed logic, such as, for example, a controller integrated circuit or microprocessor and associated memory for storing operational code and data, although other types of programmed logic may be used if desired.

A multiparameter light has its beam pattern selected and its light positioning apparatus positioned by respectively a pattern parameter and a position parameter set by the operator. In some types of multiparameter lights, patterns of light are created within the beam by the use of "gobos," which include a variety of devices inserted in the path of the beam such as stencils, lithos, liquid crystal display ("LCD") devices, digital micro-mirror ("DMM") devices, and so forth. See, e.g., U.S. Pat. No. 5,402,326, issued Mar. 28, 1995 to Belliveau and entitled "Gobo holder for a lighting system" which is hereby incorporated herein by reference in its entirely. In other types of multiparameter lights, patterns of light are created within the beam by the use of beam patterning optics, and example of which is a lenticular lens such as described in, for example, U.S. Pat. No. 6,048,080, issued Apr. 11, 2000 to Belliveau and entitled "Lighting system with variable shaped beam" which is hereby incorporated herein by reference in its entirely. The position parameter may be implemented as a single parameter, although preferably the position parameter is implemented by multiple parameters such as by a pan parameter and a tilt parameter, or by mutually exclusive pan only, tilt only, and simultaneous pan and tilt parameters.

The multiparameter light 100 preferably includes many different position sequence macros that are referenced to the position parameter. Each of the position sequence macros when activated automatically controls the position of the light positioning apparatus through preferably several different predetermined positions of pan and/or tilt which preferably are centered on the position specified in the position parameter. While a position sequence macro may also, if desired, simultaneously change one or more other parameters such as, for example, color, pattern and shutter, preferably the operator instead of the position sequence macro controls these parameters to achieve a desired creative lighting effect. If several different sequences are desired, the operator simply selects several position sequence macros. Alternatively, a position sequence macro may be designed to allow the operator to specify ranges of values for the pan and tilt parameters, although additional parameter control channels likely would be required. In another alternative, one or more of the position sequence macros may include one or more randomly varied parameters if desired. While preferably all position sequence macros are referenced to the position parameter, if desired some of the position sequence macros may operate based on the manufacturer specified initial position, or as described below based on a variable whose value is set by the operator.

When an operator sets the pattern parameter and the position parameter and selects a position sequence macro which references the position parameter, the position sequence macro will direct the patterned beam exactly to the place expected by the operator, thereby eliminating unexpected or undesired lighting effects which would occur were a factory preprogrammed position to be referenced by the position sequence macro. Preferably, the position parameter is the last operator-programmed position of the light positioning apparatus of the multiparameter light prior to initiation of the position sequence macro. The last operator-programmed position of the light positioning apparatus may or may not be used to project a light beam during a scene. As a result, an operator is able to adjust pan and/or tilt effects and indeed change them dramatically to obtain a desired lighting effect with great ease, rapidity, and flexibility. Moreover, the problem of being unable to achieve a certain desired lighting effect because one or more multiparameter lights of the lighting system were not properly oriented when installed is overcome.

In the absence of any operator programmed position, the multiparameter light may use the initial position as established by the manufacturer.

Preferably the operator programs a show on a console and stores the program on the lighting control system, from which it is later run to make the show. Alternatively, an operator may program a show or a portion of a show into the memory of one or more multiparameter lights through their respective keypads, from which the program(s) are later run. In the later case, a multiparameter light programmed through its keypad may operate itself in accordance with its stored program or operate other multiparameter lights (with or without operating itself) in accordance with its stored program over the communications system.

Figure 9:
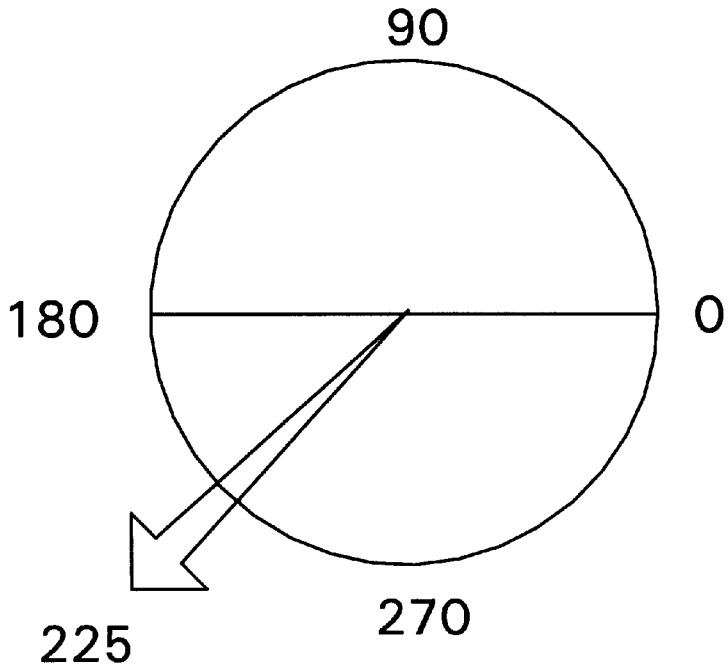
FIG. 9 is a schematic representation of a pan position as set by an operator.
Figure 10:
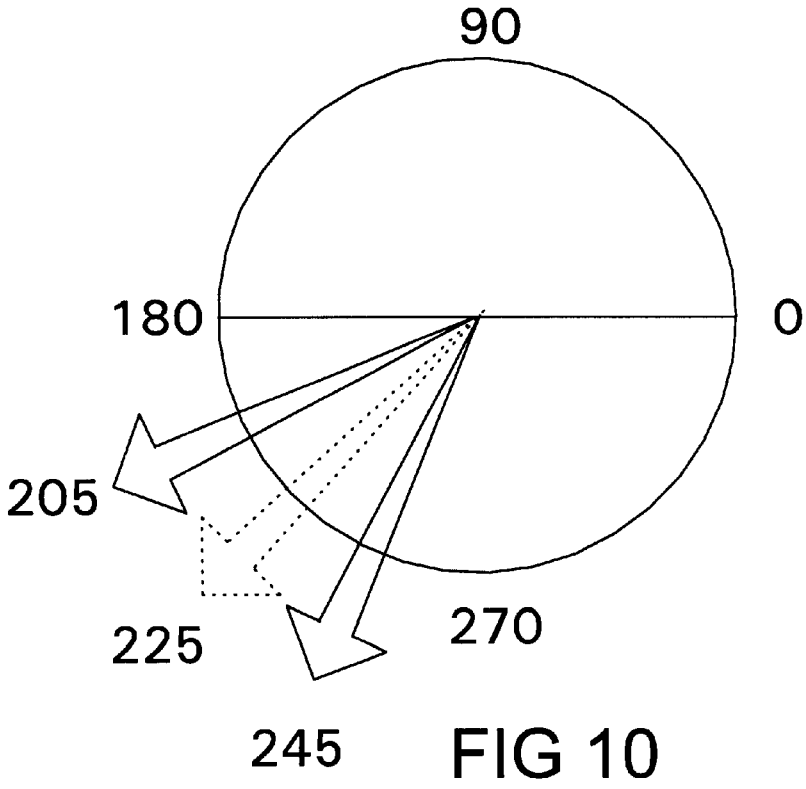
FIG. 10 is a schematic representation of pan positions achieved by a macro in accordance with the invention in response to a panning range specified by an operator.

The principle of operation of a position sequence macro that automatically centers on the last operator-programmed position of the multiparameter light is shown in FIGS. 9 and 10. FIGS. 9 and 10 pertain to pan, but the principle described with reference thereto applies equally to tilt, except that tilt typically is adjustable over a 255 degree range. FIG. 9 shows a position of 225 degrees relative to a base position of zero degrees, as indicated by the arrow projecting from the center of the 360 degree circle at the 225 degree position. The operator may set this position on a particular multiparameter light and the light positioning apparatus responds by moving into that position. Now, when the operator selects a position sequence macro that uses a 40 degree panning range, the multiparameter light references and centers on the last position of 225 degrees and pans 20 degrees on each side thereof, as shown by the arrows projecting from the center of the 360 degree circle at the 205 degree and 245 degree positions. The dotted arrow projecting from the center of the 360 degree circle at the 225 degree position represents the position of the light positioning apparatus, on which the macro automatically centers.

An illustrative list of position sequence macros referenced to the position parameter is set forth in the following table. Although sixty-one position sequence macros are listed (macro numbers 0 and 63 are "no macro"), a greater number or a lesser number may be used as desired. If a DMX control channel is used for selecting the macro, illustratively DMX control channel 23, for example, each macro has a control channel value assigned to it. Since a DMX control channel has 256 values (0 through 255), illustratively macro 1 is assigned the control channel value of 0 to 3, macro 2 is assigned the control channel value of 4 to 7, macro 3 is assigned the control channel value from 8 to 11, and so forth. In the Table, the circle macros "clk" (clockwise) and "cclk" (counterclockwise) are simultaneous pan and tilt macros in which both pan and tilt reference the position parameter.

TABLE

Figure 8:
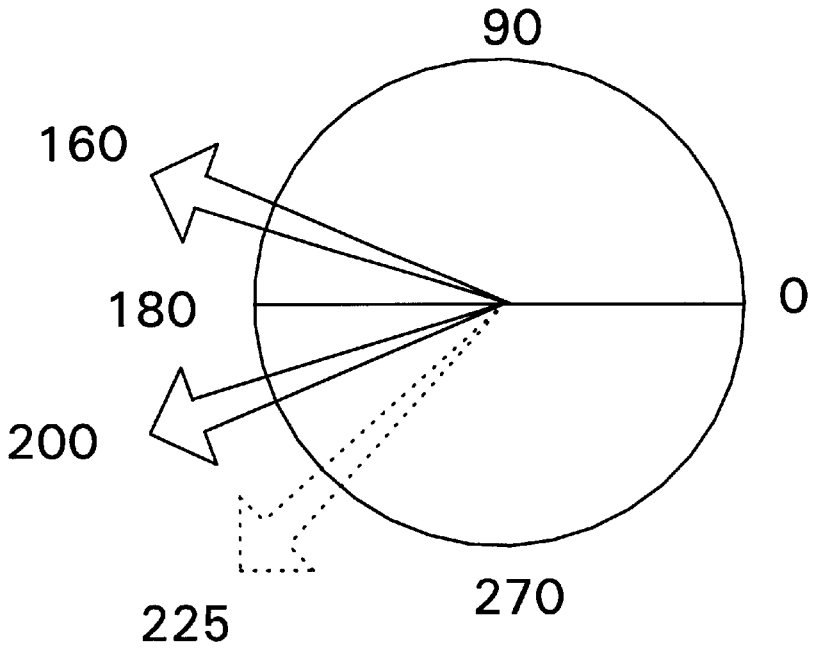
FIG 8 (PRIOR ART)
FIG. 8 is a schematic representation of pan positions achieved by a prior art macro in response to a panning range specified by an operator.

| Macro # | Effect | Speed/ Feel | Macro # | Effect | Speed/ Feel |
|---|---|---|---|---|---|
| 0 | no macro | | 33 | tilt 9 degrees | medium |
| 1 | pan 9 degrees | slow | 34 | tilt 12 degrees | medium |
| 2 | pan 12 degrees | slow | 35 | tilt 18 degrees | medium |
| 3 | pan 18 degrees | slow | 36 | filt 24 degrees | medium |
| 4 | pan 24 degrees | slow | 37 | tilt 36 degrees | medium |
| 5 | pan 36 degrees | slow | 38 | tilt 48 degrees | medium |
| 6 | pan 48 degrees | slow | 39 | tilt 60 degrees | medium |
| 7 | pan 60 degrees | slow | 40 | tilt 90 degrees | medium |
| 8 | pan 90 degrees | slow | 41 | tilt 9 degrees | fast |
| 9 | pan 9 degrees | medium | 42 | tilt 12 degrees | fast |
| 10 | pan 12 degrees | medium | 43 | filt 18 degrees | fast |
| 11 | pan 18 degrees | medium | 44 | tilt 24 degrees | fast |
| 12 | pan 24 degrees | medium | 45 | tilt 36 degrees | fast |
| 13 | pan 36 degrees | medium | 46 | tilt 48 degrees | fast |
| 14 | pan 48 degrees | medium | 47 | tilt 60 degrees | fast |
| 15 | pan 60 degrees | medium | 48 | tilt 90 degrees | fast |
| 16 | pan 90 degrees | medium | 49 | sm 12 deg circle | medium clk |
| 17 | pan 9 degrees | fast | 50 | sm 12 deg circle | medium cclk |
| 18 | pan 12 degrees | fast | 51 | med 24 deg circle | medium clk |
| 19 | pan 18 degrees | fast | 52 | med 24 deg circle | medium cclk |
| 20 | pan 24 degrees | fast | 53 | med 48 deg circle | medium clk |
| 21 | pan 36 degrees | fast | 54 | med 48 deg circle | medium cclk |
| 22 | pan 48 degrees | fast | 55 | large 60 deg circle | medium clk |
| 23 | pan 60 degrees | fast | 56 | large 60 deg circle | medium cclk |
| 24 | pan 90 degrees | fast | 57 | med 36 deg FIG. 8 | medium clk |
| 25 | tilt 9 degrees | slow | 58 | med 36 deg FIG. 8 | medium cclk |
| 26 | tilt 12 degrees | slow | 59 | large 60 deg FIG. 8 | medium clk |
| 27 | tilt 18 degrees | slow | 60 | large 60 deg FIG. 8 | medium cclk |
| 28 | tilt 24 degrees | slow | 61 | large 90 deg FIG. 8 | fast clk |
| 29 | tilt 36 degrees | slow | 62 | large 90 deg FIG. 8 | fast cclk |
| 30 | tilt 48 degrees | slow | 63 | no macro | |
| 31 | tilt 60 degrees | slow | | | |
| 32 | tilt 90 degrees | slow | | | |

A position sequence macro may be programmed in the operational code of a multiparameter light to reference a position parameter in any desired manner. For example, known position sequence macros which function on the basis of the light positioning apparatus being set to the manufacturer's specified initial position may be modified to include a declared reference position variable, to updated the position variable each time the position parameter is set, and to use the position variable as a reference for generating control signals to the light positioning apparatus.

Figure 11:
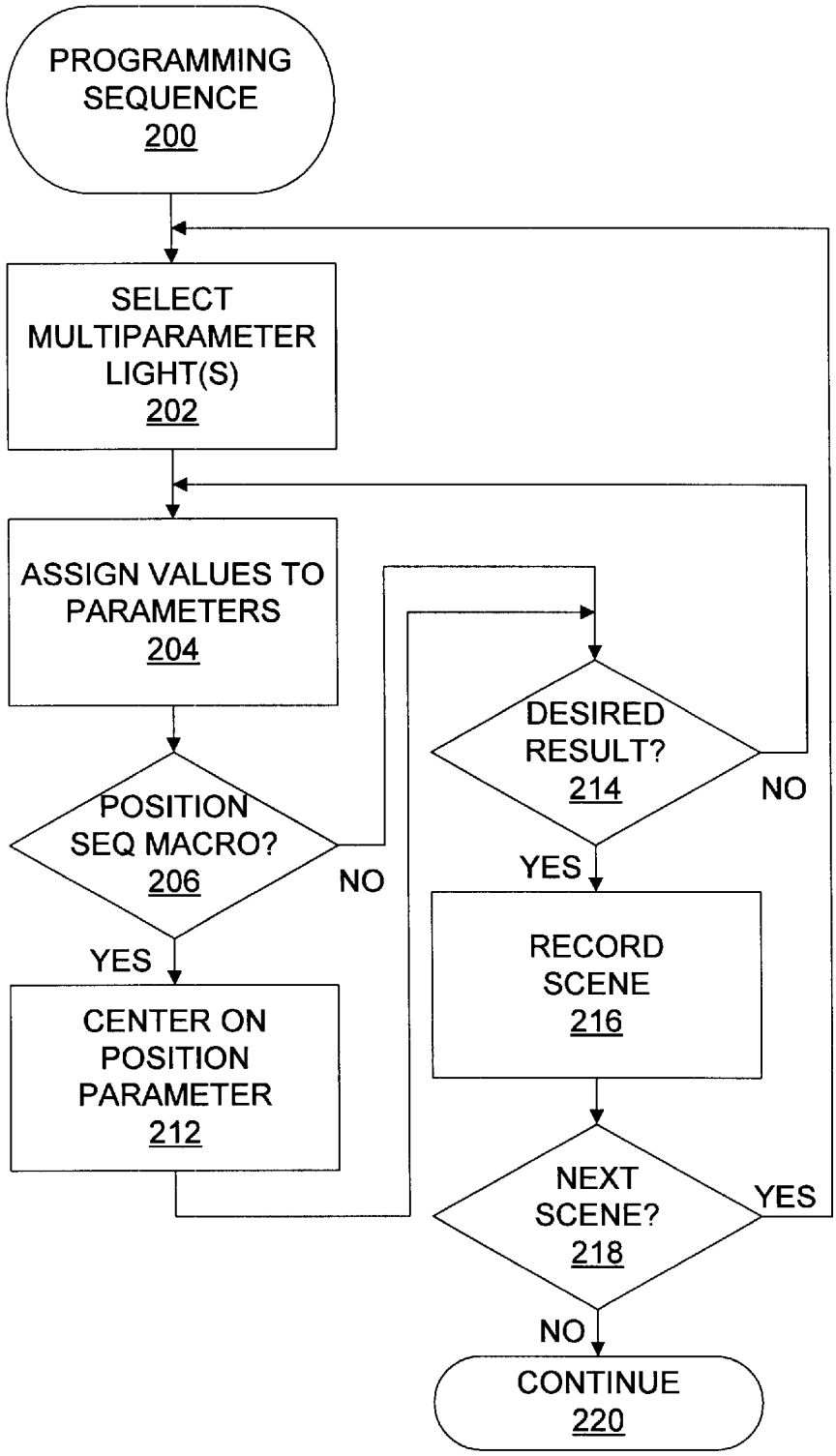
FIG. 11 is a flowchart of a show programming sequence.

The operation of a multiparameter light which a position sequence macro that automatically references and centers on the present position of light projection from a multiparameter light is shown in the illustrative show programming sequence 200 of FIG. 11. Initially the operator uses the lighting control system to select at least one multiparameter light to be involved in creating a scene (block 202). This is done, for example, by the operator inputting at the keyboard of the lighting control system the address of each of the multiparameter lights to be involved in the scene, in a manner well known in the art. For each multiparameter light involved in the scene, values are assigned to one or more parameters to be varied (block 204). In a lighting control system which uses a continuous stream of data such as under the DMX512 protocol, the lighting control system always specifies an initial value, typically zero, which may be and typically is changed by the operator inputting selections from the keyboard of the lighting control system for each of the multiparameter lights that have been addressed, in a manner well known in the art. The parameters to be varied include, for example, pattern, position of the light positioning apparatus, position sequence macro, color, iris, shutter, and so forth. If the macro parameter is set for a particular scene, the operator may rely on a pattern parameter and position parameter set for a previous scene or scenes, or may also set the pattern parameter, the position parameter, or both for the particular scene. The position sequence macro parameter is programmed by setting the channel controlling the position sequence macros to the value of the position sequence macro that is preprogrammed by the manufacturer of the multiparameter light to produce the desired effect. Preferably a dedicated position sequence macro channel of the lighting control system is used to control the selection of a position sequence macro.

If a position sequence macro is selected by the operator (blocks 206 yes), the selected position sequence macro references and preferably centers on the value of the position parameter (block 212). If a lighting control system does not use a continuous stream of data such as specified by the DMX512 protocol, it is possible that a position parameter will not be automatically specified by the lighting control system if the operator does not specify it. Multiparameter lights designed for such systems may establish an initial value for the position parameter which is superseded when the operator specifies a first value for the position parameter. Next, the operator watches the scene and decides whether the varied parameters, including any position sequence macros that have been selected, achieve the desired result (block 214). If the desired result is achieved, the operator records the scene in the memory of the lighting control system for later recall (block 216) and begins working on the next scene of the show (block 218 yes). If the desired result is not achieved (block 214 no), the operator repeats the scene programming process by modifying parameter values as necessary.

A separate position sequence macro channel is preferred because it enables the position sequence macros to operate while the direction of light projection of the multiparameter light is being changed over another channel.

The onboard display and keypad 106 of a multiparameter light may be used to vary the parameters of the multiparameter light to create a scene and even to link several scenes to create a show, and to select among various macros associated with a parameter, as is well known in the art. The onboard display and keypad 106 may also be used to select among various position sequence macros, thereby providing the operator that programs the internal control system of the multiparameter light numerous options and capabilities not previously available and saving the operator time.

If an operator should program a multiparameter light so that one of its light positioning devices such as the motors, bearings and the mechanical assembly is operated at the end of its travel (such as a physical limitation of travel of the lamp housing 110 with reference to the base 104 (FIGS. 2 through 6)), thereby exceeding its range limit, or so that a range limit preprogrammed in the operational code of the multiparameter light is reached, the position sequence macro preferably continues to center on and reference the previous position of the light positioning apparatus. However, the pan and tilt movement preferably is modified. One possible modification is for the movement to be compressed in the limited direction and to apply the same compression factor to the non-limited direction. For example, assume that a 40 degree position sequence macro expected to move plus or minus 20 degrees from the referenced position is able to move the full 20 degrees in the non-limited direction but is constrained to move only 5 degrees in the limited direction. The operational code of the multiparameter light would, illustratively, then automatically limit the range of motion to plus or minus 5 degrees from the referenced position and would also compress the movement so as to require the same time to move plus or minus 5 degrees as to move the originally specified plus or minus 20 degrees. Even though the projected light in this example would not move the original overall 40 degrees specified by the macro with reference to the operator preprogrammed position, the multiparameter light continues to function by moving the reduced overall 10 degrees in the same time period. While not exactly as intended by the operator, this motion would generally provide a pleasing visual solution to a position sequence macro that has been incorporated into a scene by an operator but where movement of a multiparameter light is restricted.

Other solutions may be used if desired for affecting a pleasing look when using a position sequence macro with a multiparameter light whose movement is restricted. Assume as in the prior example that a 40 degree position sequence macro is expected to move plus or minus 20 degrees from the referenced position, but in fact is able to move the full 20 degrees in the non-limited direction but is constrained to move only 5 degrees in the limited direction. The operational code of the multiparameter light would, illustratively, automatically limit the range of motion to 5 degrees from the referenced position in the limited direction and would also compress the movement so as to require the same time to move plus or minus 5 degrees as to move the originally specified plus or minus 20 degrees. However, the operational code would implement the fall range of motion in the non-limited direction to 20 degrees from the referenced position.

The position of the light positioning apparatus which the position sequence macro references may be programmed in any desired manner. One way is for the operator to select the beam pattern and position the light positioning apparatus using the position parameter while making a lighting effect required for that scene, so that the operator may visually confirm that the light beam is properly directed both for the lighting effect as well as that the light positioning apparatus will be properly positioned for the position sequence macro to be used in a subsequent scene. Another way is for the operator to position the light positioning apparatus using the position parameter while making any beam of light, for example a steady beam of light, to visually confirm that the light positioning apparatus will be properly positioned for the position sequence macro to be used in a subsequent scene or perhaps even in the present scene.

While referencing the position parameter is most simply achieved by centering on the value to which the position parameter is set, the position parameter may be referenced in any way desired. Some alternatives include centering on an offset from the value to which the position parameter is set, or for more complicated theatre effects, using the value to which the position parameter is set in any suitable way to generate a complex movement pattern for the light positioning apparatus, such as, for example, in a geometric equation or with values from a table.

The description of the invention and its applications as set forth herein is illustrative and is not intended to limit the scope of the invention as set forth in the following claims. Variations and modifications of the embodiments disclosed herein are possible, and practical alternatives to and equivalents of the various elements of the embodiments are known to those of ordinary skill in the art. These and other variations and modifications of the embodiments disclosed herein may be made without departing from the scope and spirit of the invention as set forth in the following claims.

What is claimed is:

1. A method of programming a lighting system comprising at least one multiparameter light, the multiparameter light comprising a light positioning apparatus controlled by a position parameter and a beam pattern selected by a pattern parameter, comprising:

providing a plurality of macros for the multiparameter light, each of the macros comprising position sequences for the light positioning apparatus referenced to the position parameter;

projecting a light beam from the light positioning apparatus;

setting the pattern parameter to impose the beam pattern on the light beam;

setting the position parameter to move the light beam to a selected location;

setting a macro parameter to activate at least one of the macros, wherein the light beam from the pattern parameter setting step is moved sequentially to a plurality of locations as determined by the position sequences of the activated macro with reference to the position parameter from the position parameter setting step;

recording the setting of the position parameter from the position parameter setting step;

recording the setting of the pattern parameter from the pattern parameter setting step; and recording the setting of the macro parameter from the macro parameter setting step.

2. A method as in claim 1 wherein:

the position parameter setting step is done for a first scene of a show;

the macro parameter setting step is done for a second scene of the show that is subsequent to the first scene; and the setting of the position parameter in the position parameter setting step is unchanged between the position parameter setting step and the macro parameter setting step.

3. A method as in claim 2 wherein:

the pattern parameter setting step is done for the first scent of the show; and the setting of the pattern parameter in the pattern parameter setting step is unchanged between the pattern parameter setting step and the macro parameter setting step.

4. A method as in claim 2 wherein the pattern parameter setting step is done for the second scene of the show.

5. A method as in claim 1 wherein the pattern parameter setting step, the position parameter setting step, and the macro parameter setting steps are done for a first scene of the show.

6. A method as in claim 1 wherein the pattern parameter setting step is done subsequent to the position parameter setting step.

7. A method as in claim 1 wherein the position parameter setting step comprises:

varying the position parameter to move the light beam from the multiparameter light to a particular location; and maintaining the position parameter when the light beam is at the particular location;

the position parameter recording step being done during the maintaining step.

8. A method as in claim 1 wherein the beam pattern comprises a gobo, further comprising inserting the gobo into a light path within the multiparameter light, subsequent to the pattern parameter setting step.

9. A method as in claim 8 further comprising rotating the gobo subsequent to the stencil inserting step.

10. A method as in claim 1 wherein the beam pattern comprises beam patterning optics.

11. A method as in claim 10 wherein the beam patterning optics is a lenticular lens.

12. A method as in claim 1 further comprising:

detecting a range limit condition; and adjusting operation of the activated macro to compensate for the range limit condition.

13. A method of operating a lighting system comprising at least one multiparameter light the multiparameter light comprising a light positioning apparatus controlled by a position parameter and a beam pattern selected by a pattern parameter, comprising:

projecting a light beam from the light positioning apparatus;

providing a pattern parameter for the multiparameter light;

providing a position parameter for the multiparameter light;

providing a plurality of macros having position sequences for the light positioning apparatus of the multiparameter light, the position sequences being referenced to the position parameter;

setting the position parameter to selectively position the light positioning apparatus; and setting a macro parameter to activate at least one of the macros;

wherein the light beam is patterned as determined by the pattern parameter and moves sequentially to a plurality of locations as determined by the position sequences of the activated macro with reference to the position parameter.

14. A method as in claim 13 wherein:

the lighting system comprises a plurality of parameter control channels;

the position parameter setting step comprises setting a first value on a first one of the parameter control channels for a first scene of a show; and the macro parameter setting step comprises setting a second value on a second one of the parameter control channels to select one of the macros for a second scene of the show, the second scene being subsequent to the first scene.

15. A method as in claim 13 wherein:

the lighting system comprises a plurality of parameter control channels;

the position parameter setting step comprises setting a first value on a first one of the parameter control channels for a scene of a show; and the macro parameter setting step comprises setting a second value on a second one of the parameter control channels to select one of the macros for the scene.

16. A method as in claim 13 wherein:

the lighting system comprises a plurality of parameter control channels; and the macro parameter setting step comprises setting a value on one of the parameter control channels to select one of the macros.

17. A method as in claim 16 wherein the channels are DMX channels.

18. A method as in claim 16 wherein the channel on which the value of the macro setting step is set is a macro control channel.

19. A method as in claim 18 wherein the macro control channel is designated for only position sequence macros.

20. A method as in claim 18 wherein the macro control channel is designated for only simultaneous pan and tilt position sequence macros.

21. A method as in claim 18 wherein the macro control channel is designated for only pan position sequence macros.

22. A method as in claim 18 wherein the macro control channel is designated for only tilt position sequence macros.

23. A method as in claim 13 wherein the lighting system comprises a lighting control system coupled to the multiparameter light, and wherein the pattern parameter setting step, the position parameter setting step, and the macro parameter setting step are performed with the lighting control system.

24. A method as in claim 13 wherein the lighting system comprises a communications system and an additional multiparameter light, the multiparameter light and the additional multiparameter light being coupled to one another by the communications system, wherein the position parameter setting step and the macro parameter setting step are performed at the additional multiparameter light.

25. A method as in claim 13 wherein the position parameter setting step and the macro parameter setting step are performed at the multiparameter light.

26. A method as in claim 25 wherein the position parameter setting step and the macro parameter setting step are performed from a keypad on the multiparameter light.

27. A method as in claim 13 further comprising:

programming a first value for the position parameter during an operator programmed first scene of a show; and programming a second value for the macro parameter during an operator programmed second scene of the show, the second scene being subsequent to the first scene.

28. A method as in claim 13 further comprising:

programming a first value for the position parameter during an operator programmed scene of a show; and programming a second value for the macro parameter during the operator programmed scene.

29. A method as in claim 13 wherein the macro providing step comprises centering the position sequences of the position sequence macros on the position parameter.

30. A method as in claim 13 wherein the macro providing step comprises centering the position sequences of the position sequence macros on an offset from the position parameter.

31. A method as in claim 13 wherein the macro providing step comprises basing the position sequences of the position sequence macros on values derived from the position parameter to generate a complex movement pattern for the light positioning apparatus.

32. A method as in claim 13 wherein the position parameter set in the position parameter setting step is unchanged until after the macro parameter setting step.

33. A method as in claim 32 wherein the pattern parameter providing step is done prior to the position parameter setting step.

34. A method as in claim 32 wherein the pattern parameter providing step is done subsequent to the position parameter setting step.

35. A multiparameter light comprising:

a beam patterning apparatus;

a light positioning apparatus capable of being variably positioned;

a communications receiver; and an internal control system coupled to the communications receiver, the beam patterning apparatus, and the light positioning apparatus, comprising:

a plurality of macros having position sequences for the light positioning apparatus;

programmed logic responsive to a first value received by the communications receiver for activating the beam patterning apparatus;

programmed logic responsive to a second value received by the communications receiver for positioning the light positioning apparatus; and programmed logic responsive to a third value received by the communications receiver for selecting at least one of the macros, the position sequences of the selected macro being referenced to the second value.

36. A multiparameter light as in claim 35 wherein the internal control system further comprises a communications transmitter.

37. A multiparameter light as in claim 35 wherein the beam patterning apparatus comprises a gobo.

38. A multiparameter light as in claim 35 wherein the beam patterning apparatus comprises beam patterning optics.

39. A multiparameter light comprising:

a beam patterning apparatus;

a light positioning apparatus capable of being variably positioned;

a keypad; and an internal control system coupled to the keypad and to the light positioning apparatus, comprising:

a plurality of macros having position sequences for the light positioning apparatus;

programmed logic responsive to a first value originating from the keypad for activating the beam patterning apparatus;

programmed logic responsive to a second value originating from the keypad for positioning the light positioning apparatus; and programmed logic responsive to a third value originating from the keypad for selecting at least one of the macros, the position sequences of the selected macro being referenced to the second value.

40. A multiparameter light as in claim 39 wherein the internal control system further comprises a communications transmitter.

41. A multiparameter light as in claim 40 further comprising a communications receiver, the internal control system being coupled to the communications receiver.

42. A multiparameter light as in claim 39 wherein the beam patterning apparatus comprises a gobo.

43. A multiparameter light as in claim 39 wherein the beam patterning apparatus comprises beam patterning optics.

44. A lighting system for producing a show, the lighting system comprising a lighting control system and at least one multiparameter light comprising:

a beam patterning apparatus;

a light positioning apparatus capable of being variably positioned;

a communications receiver coupled to the lighting control system; and an internal control system coupled to the communications receiver and to the light positioning apparatus, and comprising:

a plurality of macros having position sequences for the light positioning apparatus;

programmed logic responsive to a first value received by the communications receiver from the lighting control system for activating the beam patterning apparatus;

programmed logic responsive to a second value received by the communications receiver from the lighting control system for positioning the light positioning apparatus; and programmed logic responsive to a third value received by the communications receiver from the lighting control system for selecting at least one of the macros, the position sequences of the selected macro being referenced to the second value.

45. A lighting system as in claim 44 wherein:

the multiparameter light further comprises a keypad; and the internal control system further comprises:

programmed logic responsive to a fourth value originating at the keypad for activating the beam patterning apparatus;

programmed logic responsive to a fifth value originating at the keypad for positioning the light positioning apparatus; and programmed logic responsive to a sixth value originating at the keypad for selecting a second one of the macros, the position sequences of the selected second macro being referenced to the fifth value.

46. A lighting system as in claim 44 wherein:

the lighting control system comprises a plurality of parameter control channels, at least one of the parameter control channels being a macro control channel;

the programmed logic responsive to the first value is responsive to signals on one of the parameter control channels other than the macro control channel;

the programmed logic responsive to the second value is responsive to signals on one of the parameter control channels other than the macro control channel; and the programmed logic responsive to the third value is responsive to signals on the macro control channel.

47. A lighting system as in claim 46 wherein the parameter control channels are DMX channels.

48. A lighting system as in claim 46 wherein the macro control channel is designated for only position sequence macros.

49. A lighting system as in claim 46 wherein the macro control channel is designated for only simultaneous pan and tilt position sequence macros.

50. A lighting system as in claim 46 wherein the macro control channel is designated for only pan position sequence macros.

51. A lighting system as in claim 46 wherein the macro control channel is designated for only tilt position sequence macros.

52. A lighting system as in claim 44 wherein the position sequences referenced to the first value are centered on the first value.

53. A lighting system as in claim 44 wherein the position sequences referenced to the first value are centered on an offset from the first value.

54. A lighting system as in claim 44 wherein the position sequences referenced to the first value are based on values derived from the position parameter to generate a complex movement pattern for the light positioning apparatus.

* * * * *